US008232855B2

(12) United States Patent
El-Barbari et al.

(10) Patent No.: US 8,232,855 B2
(45) Date of Patent: Jul. 31, 2012

(54) HIGH ENERGY DENSITY INDUCTOR

(75) Inventors: Said Farouk Said El-Barbari, Freising (DE); Stefan Schroeder, Munich (DE); Robert Roesner, Unterfoehring (DE)

(73) Assignee: General Electric Company, Niskayuna, NY (US)

( * ) Notice: Subject to any disclaimer, the term of this patent is extended or adjusted under 35 U.S.C. 154(b) by 214 days.

(21) Appl. No.: 12/334,572

(22) Filed: Dec. 15, 2008

(65) Prior Publication Data

US 2010/0148909 A1 Jun. 17, 2010

(51) Int. Cl.
*H01F 27/10* (2006.01)
*H01F 27/08* (2006.01)
*H01F 27/28* (2006.01)

(52) U.S. Cl. ..... 336/57; 336/55; 336/58; 336/232

(58) Field of Classification Search ..... None
See application file for complete search history.

(56) References Cited

U.S. PATENT DOCUMENTS

| | | | | |
|---|---|---|---|---|
| 6,278,353 | B1 * | 8/2001 | Downing et al. | 336/200 |
| 6,522,233 | B1 * | 2/2003 | Kyoso et al. | 336/200 |
| 6,636,140 | B2 * | 10/2003 | Fujiyoshi et al. | 336/200 |
| 7,289,329 | B2 * | 10/2007 | Chen et al. | 361/707 |
| 2004/0136208 | A1 | 7/2004 | Agarwal et al. | |
| 2006/0108684 | A1 | 5/2006 | Stevanovic et al. | |
| 2009/0261933 | A1 * | 10/2009 | Kiuchi et al. | 336/57 |

* cited by examiner

*Primary Examiner* — Anh Mai
*Assistant Examiner* — Mangtin Lian
(74) *Attorney, Agent, or Firm* — Scott J. Asmus

(57) ABSTRACT

A substrate layer for use in an inductor is provided. The substrate layer comprises traces disposed on a first side of the substrate layer, wherein the traces are configured to facilitate conduction of current in a winding of the inductor, a sealing layer disposed on a second side of the substrate layer, wherein the sealing layer is configured to provide a sealing border for an electrically isolated cooling channel and an interconnect foil disposed on the second side of the substrate layer, wherein the interconnect foil is configured to facilitate operationally coupling the substrate layer to a second substrate layer. Further, the first substrate layer and the second substrate layer may be operationally coupled to form a winding for use in an inductor with an electrically isolated cooling channel in between.

16 Claims, 4 Drawing Sheets

HIGH ENERGY DENSITY INDUCTOR

BACKGROUND

The invention relates generally to inductors and more specifically to a design of high energy density inductors.

As will be appreciated, there has been significant development in areas related to power conversion. Significant reduction in size and thickness of chips used in power semiconductors has been achieved. Unfortunately, this reduction in size typically leads to reduced thermal capacity of the power semiconductors.

Further, with regard to passive components, currently used techniques have failed to provide significant reduction in size of the passive components. By way of example, an alternating current (AC) or direct current (DC) power supply typically includes several passive components such as inductors and capacitors. In these power supplies the inductors may make up to 50% of the total weight. Hence, it may be highly desirable to reduce the size of the inductors.

Currently available techniques attempt to reduce the size of the inductor by increasing the switching frequency of the power inverter or by developing new core materials that have a high flux density and low hysteresis losses. However, increasing the switching frequency disadvantageously results in increased switching losses of the power semiconductor. Moreover, certain other techniques attempt to reduce the size of the inductor by increasing the current density. Unfortunately, in a standard design of the inductor, the current density is limited by the maximum amount of losses that may be produced in the winding.

Moreover, in traditional inductors, a polymer isolator is generally disposed between the windings; however, the polymer isolator typically has a poor thermal conductivity (e.g., 0.17 $Wm^{-1}K^{-1}$). Therefore, it is difficult to transfer the heat due to losses from the interior of the winding, thereby resulting in heating of the inductors.

It may therefore be desirable to develop a design of an inductor with efficient cooling capabilities. More particularly, it may be desirable to develop a design configured to enhance the cooling capabilities of the inductor by employing isolation materials with high thermal conductivity.

BRIEF DESCRIPTION

Briefly in accordance with one aspect of the technique a substrate layer for use in an inductor is provided. The substrate layer comprises one or more traces disposed on a first side of the substrate layer, wherein the one or more traces are configured to facilitate conduction of current in a winding of the inductor, a sealing layer disposed on a second side of the substrate layer, wherein the sealing layer is configured to provide a sealing border for an electrically isolated cooling channel and an interconnect foil disposed on the second side of the substrate layer, wherein the interconnect foil is configured to facilitate operationally coupling the substrate layer to a second substrate layer.

In accordance with another aspect of the present technique a winding for use in an inductor is provided. The winding comprises a first substrate layer having a first side and a second side; a second substrate layer having a first side and a second side, wherein the second side of the second substrate layer is disposed adjacent to the second side of the first substrate layer to form an electrically isolated cooling channel therebetween, and wherein each of the first and the second substrate layers comprises one or more traces disposed on a corresponding first side of the substrate layers, wherein the one or more traces are configured to facilitate conduction of current in the winding of the inductor, a sealing layer disposed on a corresponding second side of substrate layers, wherein the sealing layer is configured to provide a sealing border for the electrically isolated cooling channel. Further, the winding comprises an interconnect foil disposed on the second side of the substrate layers, wherein the interconnect foil is configured to facilitate operationally coupling the first substrate layer to the second substrate layer.

In accordance with yet another aspect of the present technique a winding for use in an inductor is provided. The winding comprises a first substrate layer having a first side and a second side wherein the first substrate layer comprises one or more traces disposed on the first side of the first substrate layer, wherein the one or more traces are configured to facilitate conduction of current in the winding of the inductor, a second substrate layer having a first side and a second side, a sealing layer disposed on the first side of the second substrate layer, wherein the sealing layer is configured to provide a sealing border for an electrically isolated cooling channel and an interconnect foil disposed on the first side of the second substrate layer, wherein the interconnect foil is configured to facilitate operationally coupling the first substrate layer to the second substrate layer.

In accordance with a further aspect of the present technique an inductor is provided. The inductor comprises a core, a plurality of windings arranged along a first direction to form a stack, wherein each winding comprises a first substrate layer, a second substrate layer disposed adjacent to the first substrate layer to form an electrically isolated cooling channel therebetween.

In accordance with yet another aspect of the present technique a method for assembling an inductor is provided. The method provides for creating a plurality of windings, wherein each winding comprises a first substrate layer and a second substrate layer with an electrically isolated cooling channel therebetween, arranging the plurality of windings in a first direction to form a stack coupling the plurality of windings in the stack and arranging the stack of plurality of windings around a core to form the inductor.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As discussed in greater detail below, embodiments of the present invention describe a high energy density inductor and methods for preparing the same. As used herein an exemplary high energy density inductor may be used in a variety of applications such as harmonics and as an EMI filter. Further, the embodiments of the present invention may be utilized in transformers that may be used for galvanic isolations in DC/DC converters or coupling of inverter/converters in current or voltage interleaving technologies, generators and motor winding construction.

Figure 1:
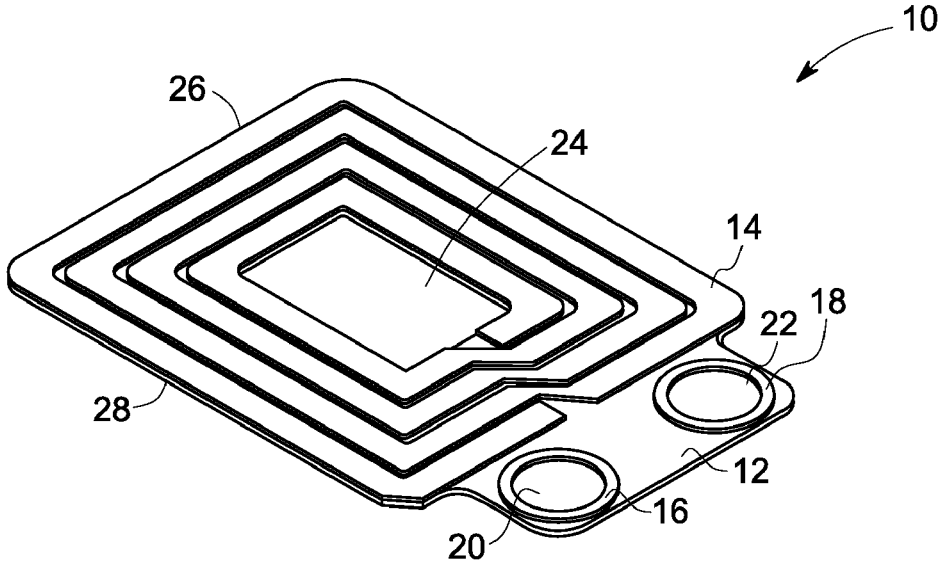
FIG. 1 is a perspective view of a first side of an exemplary substrate configured for use in the exemplary inductor of FIG. 6, in accordance with aspects of the present technique.

FIG. 1 illustrates a perspective view 10 of a first side 26 of an exemplary substrate layer 12 according to one aspect of the present invention. As depicted in FIG. 1, the substrate layer 12 has a first side 26 and a second side 28. In accordance with the aspects of the present technique, the substrate layer 12 may be made of Aluminum Oxide, Aluminum Nitride, Silicon Nitride or any good thermal conducting material with good electrical isolation property. The substrate should feature mechanical robustness and thermal stability as well a combination thereof. More particularly, any material possessing good thermal conductivity may be employed to form the substrate layer 12. By way of example, a material having good thermal conductivity may include any material having thermal conductivity in a range from about 180 W/mK to about 1000 W/mK. Also, any material possessing good electrical isolation properties may be employed to form the substrate layer 12. By way of example a material having good electrical isolation properties may include any material having electrical isolation in a range from about 2.7 kV to about 10 kV.

Furthermore, one or more traces 14 may be disposed on the first side of the substrate layer 12. Moreover, the traces 14 may be arranged in a manner so as to facilitate conduction of current. Also in certain embodiments, the one or more traces 14 may include copper traces, aluminum traces, silver traces, or combination thereof. The substrate layer 12 includes an inlet hole 20 and an outlet hole 22. The inlet and outlet holes 20, 22 may be configured to facilitate circulation of a coolant in a cooling channel. The coolant may include a liquid coolant or a gaseous coolant. In one embodiment, the coolant may include water. Moreover, the inlet and outlet holes 20, 22 may be sealed by sealing rings 16 and 18 respectively. The sealing rings 16 and 18 may include one or more copper traces, aluminum traces, silver traces and so forth to facilitate providing a uniform thickness on the side of the substrate layer 12. Further, the sealing rings 14 and 16 may be constructed from an electrically conducting or an electrically non-conducting material. Further, reference numeral 24 may generally be indicative of a cavity in the substrate layer 12.

Figure 2:
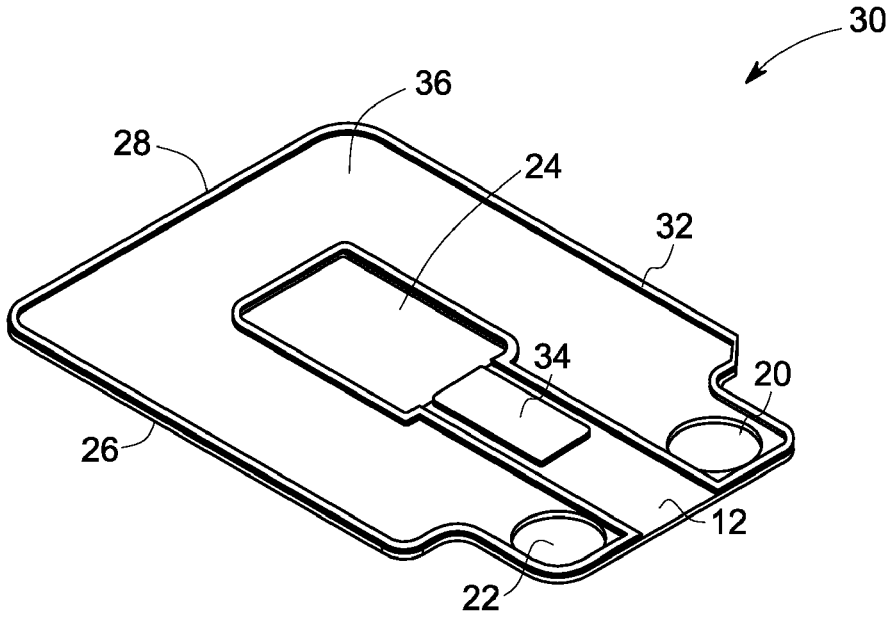
FIG. 2 is perspective view of a second side of an exemplary substrate configured for use in the inductor of FIG. 6, in accordance with aspects of the present technique.

Referring now to FIG. 2 a perspective view 30 of the second side 28 of the exemplary substrate layer 12 is provided according to one aspect of the present technique. In accordance with the aspects of the present technique a sealing layer 32 is disposed on the second side 28 of the substrate layer 12 to provide a sealing border. Moreover, the sealing layer 32 may be formed from material such as, but not limited to, one or more copper traces, one or more aluminum traces, one or more silver traces, one or more glass traces, one or more aluminum oxide traces, one or more aluminum nitride traces, one or more silicon nitride traces. Further, the sealing layer 32 may be formed from an electrically conducting material or an electrically non-conducting material. Further, this sealing border may be configured to form a cooling channel 36 for the flow of cooling material through the inlet hole 20 and the outlet hole 22. The substrate layer 12 may also include an interconnect foil 34 configured to facilitate electrical coupling of a plurality of substrate layers as will be described in greater detail hereinafter. According to the aspects of the present technique, the interconnect foil 34 may include a copper foil in certain embodiments.

Figure 3:
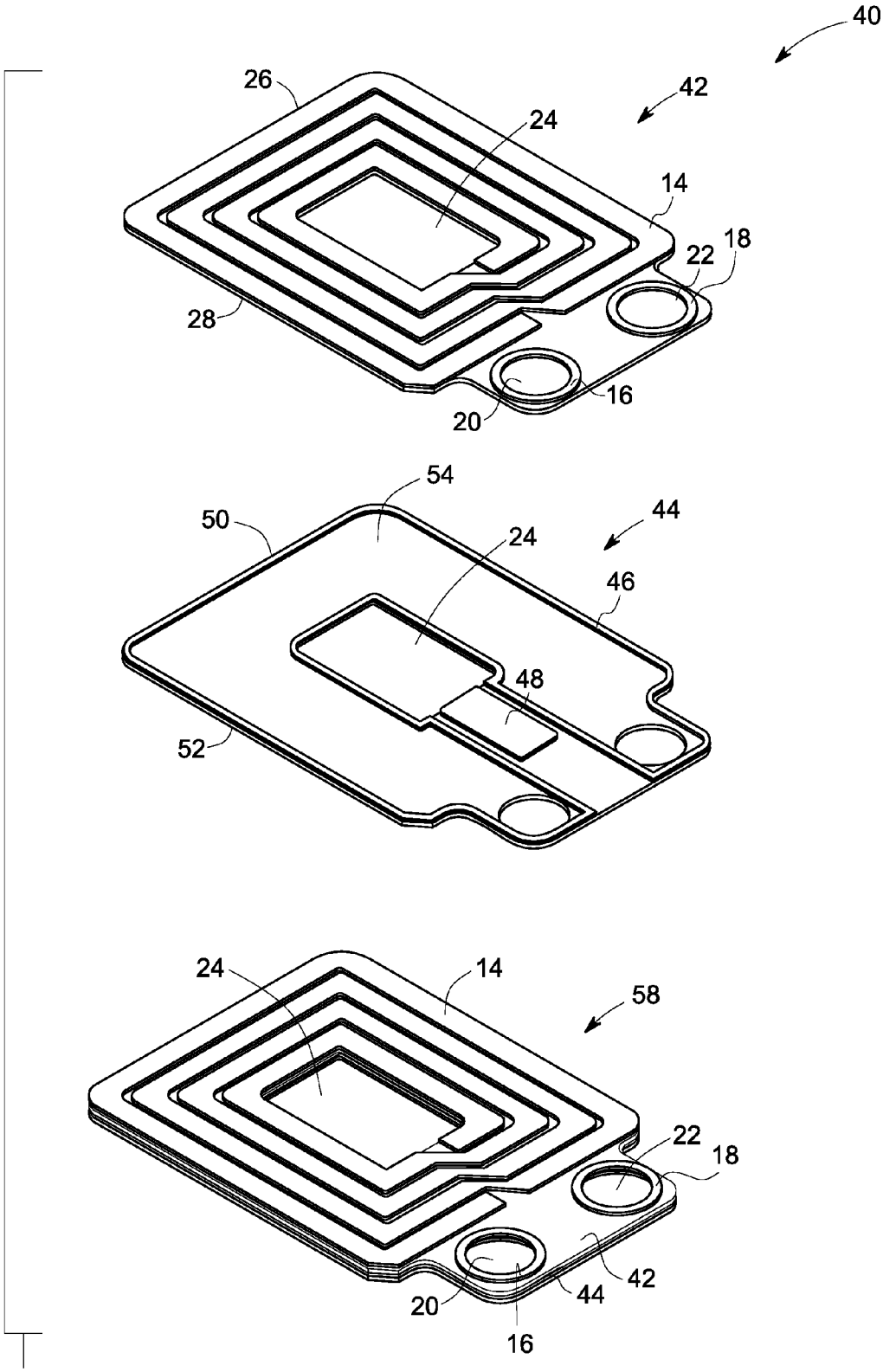
FIG. 3 is a diagrammatic illustration of forming an exemplary winding, configured for use in the inductor of FIG. 6 in accordance with aspects of the present technique.

Referring now to FIG. 3 a diagrammatic illustration of a method 40 for forming an exemplary winding 58 for use in an inductor is presented. According to the aspects of the present technique, the winding 58 may be formed by operationally coupling a first substrate layer 42 and a second substrate layer 44. As may be noted the substrate layer 12 as in FIG. 1 and FIG. 2 is illustrative of the first substrate layer 42. In accordance with exemplary aspects of the present technique, a first substrate layer 42 with copper traces 14 disposed on the first side 26 and a first sealing layer 32 and a first interconnect foil 34 disposed on the second side 28 (See FIG. 2) may be coupled to a second substrate layer 44 with copper traces disposed on a corresponding second side 52 and a second sealing layer 46 and a second interconnect foil 48 disposed on a corresponding first side 50 to form a winding 58.

More particularly, the first side 26 of the first substrate layer 42 is operationally coupled to the second side 52 of second substrate layer 44 to form a winding 58 configured for use in an inductor. In other words the first substrate layer 42 and the second substrate layer 44 may be connected in a manner such that the copper traces on both the sides are exactly the same. The inner ends of the copper traces in the first substrate layer 42 and the second substrate layer 44 are connected together via the interconnect foils maintaining the current direction in the winding. Additionally, the outer ends of the copper traces in the corresponding first substrate layer 42 and the second substrate layer 44 may form the electrical input and output for a winding. Further, the first sealing layer 32 on the first substrate layer 42 and the second sealing layer 46 on the second substrate layer 44 may be coupled to form an electrically isolated cooling channel between the first and the second layers. In one exemplary embodiment, the first substrate layer 42 and the second substrate layer 44 may be bonded together using techniques such as but not limited to Double bounded Copper (DBC) or Active Metal Braze (AMB) to form a winding.

In one embodiment, the first substrate layer 42 may include a single hole that may be configured as an inlet or an outlet. Similarly, the second substrate layer 44 may also include a single hole that may be configured as an inlet or an outlet. As noted previously, the first substrate layer 42 and the second substrate layer 44 may be bonded together to form a winding.

The above-described technique may then be performed on a plurality of substrate layers to form a plurality of windings. These sets of windings may then be glued, soldered or otherwise constructed together to form an exemplary inductor according to the aspects of the present technique.

Figure 4:
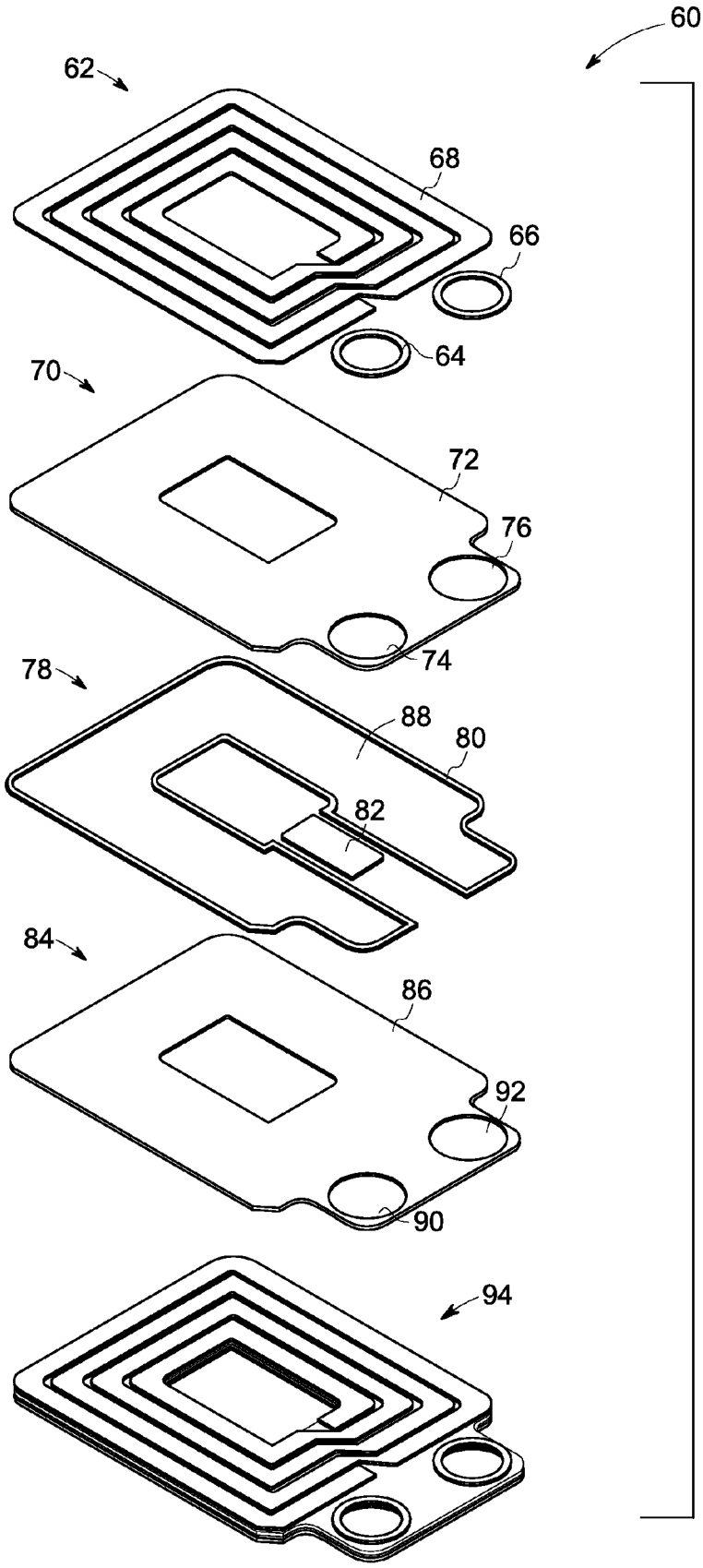
FIG. 4 is a diagrammatic illustration of forming of another exemplary winding, configured for use in the inductor of FIG. 6 in accordance with aspects of the present technique.

Turning now to FIG. 4, another embodiment of forming a winding for use in an inductor is illustrated. A winding layer 62 in the present example may include copper traces 68 arranged in a pattern and sealing rings 64 and 66 disposed in a pattern to be disposed on a first substrate layer 70. More particularly, the winding layer 62 may be disposed on a first side 72 of the first substrate layer 70. In addition, sealing rings 64 and 66 may also be disposed on the first substrate layer 70 to form a border for an inlet hole 74 and an outlet hole 76 respectively on the first substrate layer 70. Also, a sealing layer 78 including a sealing border 80 and an interconnect foil 82 may be disposed on the first side 86 of the second substrate layer 84 to form a cooling channel 88. As previously noted, a coolant may be circulated through the cooling channel 88 via an inlet hole 90 and an outlet hole 92. Subsequently, the first and the second substrate layer 70, 84 may be operationally coupled to form a winding with the cooling channel formed between the first and the second substrate layer 70 and 84. More particularly, a second surface of the first substrate layer 70 may be disposed adjacent to the top surface 86 of the second substrate layer 84. As previously noted, the first substrate layer 70 and the second substrate layer 84 may be bonded together by techniques such as, but not limited to DBC or AMB to form a winding 94.

In one embodiment, the first substrate layer 70 may include a single hole for an inlet or an outlet. Similarly, the second substrate layer 84 may include a single hole for an inlet or an outlet. In one example, a hole in the first substrate layer 70 may be configured as an inlet and a hole in the second substrate layer 84 may be configured as an outlet for a cooling material or a coolant. The exemplary arrangement of inlet and outlet hole in the present embodiment may be configured to form a series connection of a cooling channel.

Figure 5:
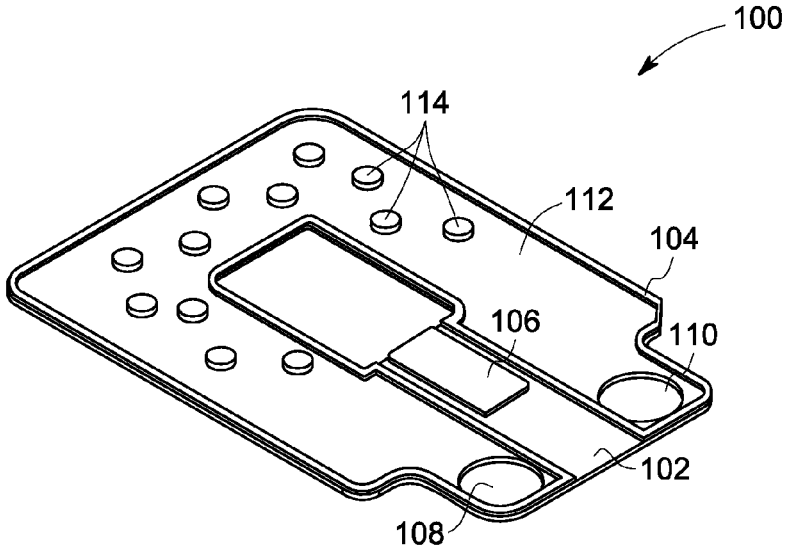
FIG. 5 is a perspective view of a second side of another exemplary substrate configured for use in the inductor of FIG. 6, in accordance with aspects of the present technique.

FIG. 5 illustrates a perspective view 100 of a substrate layer 102 configured for use in an inductor according to another aspect of the present technique. Here again, a sealing layer 104 may be disposed on the side of the substrate layer 102. An inlet hole 108 and an outlet hole 110 allow the cooling material or a coolant in the cooling channel 112 that is bordered by a sealing layer 104. Furthermore, in the presently illustrated embodiment the cooling channel 112 may include a plurality of pin fins 114. The pin fins 114 may be used to enhance the thermal performance in an inductor by adding turbulences to the coolant or cooling liquid. Additionally, the pin fins 114 may be used to support the mechanical structure of the inductor against contraction of the winding layers, which may cause a break down of the substrate layer. An interconnect foil 106 disposed on the second side may be used for operationally coupling a second substrate layer to the first substrate layer.

Figure 6:
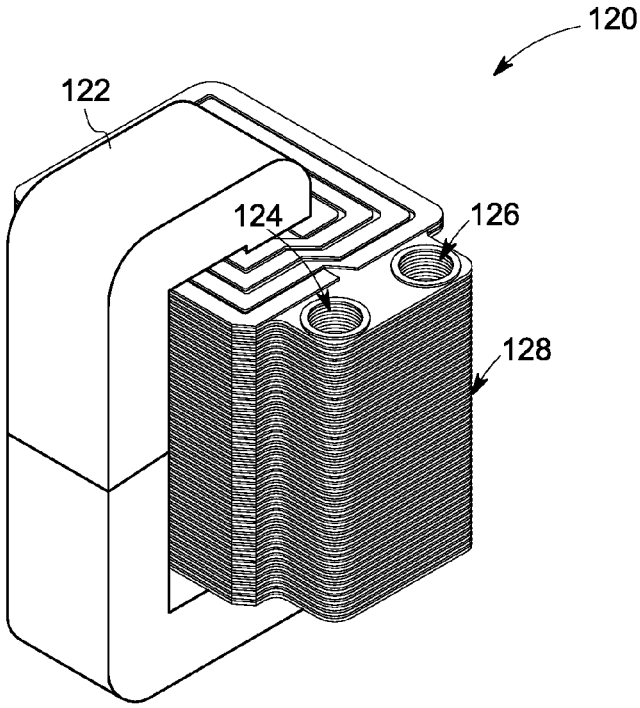
FIG. 6 is a perspective view of an exemplary assembled inductor, in accordance with aspects of the present technique.

FIG. 6 illustrates an exemplary inductor 120 that may be formed by stacking a plurality of windings such as winding 40, 94. Reference numeral 128 is representative of a stacked structure of winding. More particularly, the windings may be stacked in a manner such that a first winding and a second winding are disposed in a pattern where the second side of the second winding is disposed adjacent to the second side of the first winding. The plurality of windings 128 when stacked form an inlet pipe 124 and an outlet pipe 126 to facilitate the flow of cooling liquid or coolant between the windings. According to aspects of the present technique an end of the inlet pipe 124 and an end of the outlet pipe 126 may be closed. In one embodiment, the inlet and outlet connection for the inlet and outlet of cooling material may be on the same side or on the opposite side. Further, a core 122 may be configured to pass through the stack of windings 128 to form the inductor 120.

In accordance with another aspect of the present technique, an inductor may be formed by stacking a plurality of windings, wherein the inlets and the outlets form an alternating arrangement in the stack of windings.

Alternately, windings, such as the windings 40 (see FIG. 3) may be disposed adjacent to one another to form a stack of windings 128 for use in forming the inductor 120. A core 122 may then be passed between the empty space 24 of FIG. 1 and FIG. 2 to complete the inductor 120.

The exemplary inductor 120 described hereinabove has several advantages including efficient cooling of the windings. Additionally, high current density may be reached by the present design of the inductor. In one example, a high current density may include a current density of about 100 A/mm$^2$. The inductor may be utilized in applications that use AC/DC, DC/AC or DC/DC for power conversion. Further, the present design of the inductor may also be extended to include parasitic capacitors between the substrate layers and the winding layers, which may be utilized to design filters. The design may be utilized to generate certain resonant frequency that may be used in soft switching inverter/converter topologies.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An inductor, comprising:

a core;

a plurality of windings arranged along a first direction to form a stack, wherein each winding comprises:

a first substrate layer comprising one or more traces disposed on a first side, wherein the one or more traces are configured to facilitate conduction of current in a corresponding winding of the inductor; and a second substrate layer disposed adjacent to the first substrate layer to form a cooling channel therebetween, the cooling channel having walls formed of electrically isolating material, wherein each of the first substrate layer and the second substrate layer comprise at least one coolant hole for circulation of a coolant in the cooling channel.

2. The inductor of claim 1, wherein the one or more traces comprise copper traces, aluminum traces, silver traces, or combinations thereof.

3. The inductor of claim 1, wherein the one or more traces comprise an electrically conducting material.

4. The inductor of claim 1, wherein the second substrate layer comprises:

a sealing layer disposed on a first side, wherein the sealing layer is configured to provide a sealing border for the electrically isolated cooling channel.

5. The inductor of claim 4, wherein the sealing layer comprises an electrical conducting material.

6. The inductor of claim 4, wherein the sealing layer comprises a non-conducting material.

7. The inductor of claim 4, further comprising an interconnect foil disposed on the first side of the second substrate layer, wherein the interconnect foil is configured to provide interconnection between the first substrate layer and the second substrate layer.

8. The inductor of claim 1, wherein the first substrate layer is bonded to the second substrate layer.

9. The inductor of claim 1, wherein the first substrate layer and the second substrate layer comprise a ceramic material.

10. The inductor of claim 1, wherein each of the first substrate layer and the second substrate layer comprises aluminum nitride, silicon nitride or a combination thereof.

11. The inductor of claim 1, wherein the second substrate layer further comprises a plurality of pin fins configured to enhance cooling of the inductor.

12. A method for assembling an inductor, comprising:

creating a plurality of windings, wherein each winding comprises a first substrate layer and a second substrate layer disposed adjacent to the first substrate layer to form a cooling channel therebetween, and disposing a plurality of conductive traces on a first side of the first substrate layer, wherein each of the first substrate layer and the second substrate layer comprise at least one coolant hole for circulation of a coolant in the cooling channel, the cooling channel having walls formed of electrically isolating material, and;

arranging the plurality of windings in a first direction to form a stack;

coupling the plurality of windings in the stack; and arranging the stack of plurality of windings around a core to form the inductor.

13. The method of claim 12, wherein creating a plurality of windings comprises:

disposing a plurality of conductive traces on a first side of the second substrate layer;

disposing a sealing layer on a corresponding second side of the first substrate layer and the second substrate layer;

disposing an interconnect foil on the corresponding second side of the first substrate layer and the second substrate layer; and positioning the second side of the second substrate layer adjacent to the second side of the first substrate layer to form an electrically isolated cooling channel therebetween.

14. The method of claim 12, wherein the first direction includes a vertical direction, a horizontal direction, or a combination thereof.

15. The method of claim 12, further comprising creating an inlet and an outlet on the first substrate layer and the second substrate layer.

16. The method of claim 13, further comprising interconnecting the plurality of windings through the interconnect foil disposed on the second side of each second substrate layer.

* * * * *